United States Patent [19]

Nelson

[11] Patent Number: 5,048,162

[45] Date of Patent: Sep. 17, 1991

[54] MANUFACTURING THIN WALL STEEL CARTRIDGE CASES

[75] Inventor: Stanley R. Nelson, Minneapolis, Minn.

[73] Assignee: Alliant Techsystems Inc., Minnetonka, Minn.

[21] Appl. No.: 612,532

[22] Filed: Nov. 13, 1990

[51] Int. Cl.[5] ..... B21D 51/54

[52] U.S. Cl. ..... 29/1.2; 29/1.23; 29/1.3

[58] Field of Search ..... 29/1.21, 1.23, 1.3, 29/1.2

[56] References Cited

U.S. PATENT DOCUMENTS

| | | | |
|---|---|---|---|
| 1,296,842 | 3/1919 | Offutt et al. . | |
| 1,924,099 | 8/1933 | Bain et al. . | |
| 2,028,996 | 1/1936 | Sautier . | |
| 2,220,652 | 11/1940 | Irman . | |
| 2,286,064 | 6/1942 | Coxe . | |
| 2,371,716 | 3/1945 | Snell | 29/1.3 |
| 2,698,268 | 12/1954 | Lyon | 29/1.3 X |
| 3,187,402 | 6/1965 | Duffield . | |
| 3,614,816 | 10/1971 | Weyhmuller et al. . | |
| 3,659,528 | 5/1972 | Santala . | |
| 3,706,118 | 12/1972 | Hilton et al. . | |
| 3,761,322 | 9/1973 | Winter et al. . | |
| 3,838,497 | 10/1974 | Rizzitano et al. . | |
| 3,873,375 | 3/1975 | Bolen et al. . | |
| 4,041,868 | 8/1977 | Rayle et al. . | |
| 4,246,844 | 1/1981 | Segmiller et al. | 29/1.2 X |
| 4,494,461 | 1/1985 | Pryor et al. . | |
| 4,638,535 | 1/1987 | Pryor et al. . | |
| 4,762,559 | 8/1988 | Penrice et al. . | |
| 4,774,745 | 10/1988 | Carter | 29/1.2 X |

OTHER PUBLICATIONS

Rees, T. W. and L. C. Shaheen, "Metallic Tube Production", Encyclopedia of Materials Science and Engineering, Massachusetts Institute of Technology, vol. 4, pp. 2987–2989.

*Primary Examiner*—Timothy V. Eley
*Assistant Examiner*—C. Richard Martin
*Attorney, Agent, or Firm*—Haugen and Nikolai

[57] ABSTRACT

High strength, high precision thin-walled cartridge cases are manufactured from a metal of interest selected from low alloy and carbon steels utilizing an extrusion and heat treating process. The cartridge blanks are extruded to a length greater than that necessary for the finished cartridge case and are provided with one or more peripheral grooves close to the open end of the extruded cartridge blank to prevent warpage during subsequent heat treatment.

24 Claims, 2 Drawing Sheets

MANUFACTURING THIN WALL STEEL CARTRIDGE CASES

UNITED STATES GOVERNMENT RIGHTS

United States Government has contributed to the design and/or development of the invention herein and, thereby, has acquired ownership of certain rights in the invention.

BACKGROUND OF THE INVENTION

1. Field of the Invention

The present invention is directed generally to a process for forming thin-walled, elongated tubing members, particularly of steel or alloy steel, having superior mechanical properties. In particular, the invention is directed to a process for creating very high strength straight sidewall extruded high performance cartridge cases having superior mechanical properties.

2. Description of the Related Art

In today's high performance, high firing rate small and medium caliber guns and cannons, the firing chambers are relatively lightweight. This means that the cartridge case is not rigidly surrounded and contained in a massive structure so it is relatively free to expand and undergo some distortion when fired. This is especially true with regard to transverse dimensional integrity.

Therefore, in the manufacture of thin-walled, elongated, high strength tubing members, for use in high performance cartridge casings for medium caliber (20–50 mm) military applications, it is necessary to form the member from a material which will withstand the temperatures and extreme pressures associated with firing the shells. These include a sufficient fracture toughness to withstand the shock associated with firing and high strength such that when the shell expands during firing, it will thereafter contract predictably so that the ejection process can proceed normally and the shell will not stick in the firing chamber. This is especially critical in the case of straight sided firing chambers in which the shell is ejected by being caused to pass on through the chamber in a through-breech manner. Conventional medium caliber cartridges, on the other hand, employ tapered cartridge cases with tapered walls which exit the chamber through the same end as they enter. Dimensional tolerance and flow free case requirements for these conventional applications, while significant, are far less stringent than those for the straight sided case applications. Relatively large, thin walls characterize these cases which must fit a straight sided chamber, be fired, and then pass through the chamber to exit the system. Very little room for distortion exists if shell sticking is to be avoided.

High performance shell casings of the class described are manufactured from alloy steels, particularly high strength alloys. Particular materials which have been found very useful for such ammunition cases include modified American Iron and Steel Institute (A.I.S.I.) 4027 to 4042 grade which includes molybdenum and a small amount of chromium to insure proper hardenability. Materials which may later produce stringers or inclusions on the finished product must be eliminated or controlled. Boron grade steels, for example, are not recommended because titanium nitride inclusions may occur. These inclusions have the potential for allowing case splits or failures in the relatively long, thin-walled cases. Likewise, stringers in the finished product occasioned by the presence of uncontrolled residual alumina ($Al_2O_3$) in the melt are undesirable for the same reason.

It is well known that iron and iron alloys may take one of several crystalline structures with respect to the position of the iron atoms in the structure. Austenite is one form defined as a solid solution of one or more elements in face-centered cubic iron. Although it may including other elements such as nickel and/or chromium, the solute is generally assumed to be carbon. Ferrite, on the other hand, is a solid solution of one or more elements in body-centered cubic iron, which, unless otherwise designated, is assumed to be carbon. Martensite, on the other hand, is defined as a metastable phase of steel formed by the transformation of austenite which occurs below an initial transition temperature known as the $M_s$ temperature. Martensite is an interstitial supersaturated solid solution of carbon and iron which has a body-centered tetragonal lattice. Its microstructure is characterized by an acicular or needle-like pattern.

Other structures encountered in heat treatment processes of interest to the process of the present invention include cementite, which is a compound of iron and carbon known chemically as iron carbide and having the approximate chemical formula $Fe_3C$. Cementite is characterized by an orthorhombic crystal structure and the chemical composition of a phase of the material may be affected by the presence of other carbide-forming elements such as manganese. Pearlite is a lamellar aggregate of ferrite and cementite.

Transformation from a face-centered structure such as austenite to a body-centered form such as martensite is normally accompanied by a volume expansion of the material. This is due to a rearrangement of the iron atoms to a structure that is less densely packed.

After one or more extrusion and ironing steps associated with conventional or prior art cartridge case manufacture, steel cases are heat treat hardened (quench and temper). This process creates a volume expansion and warpage characteristic totally unsuitable for the straight sided constant wall thickness case described by this disclosure.

Accordingly, it is a primary object of the present invention to provide a process for manufacturing very high strength, formed, cartridge cases of required transverse yield strength which meet necessary dimensional tolerance requirements.

It is a further object of the present invention to accomplish yield strength characteristics in alloy steel tubing utilizing a relatively inexpensive process which increases the yield strength in the transverse direction without warpage and produces relatively defect-free cartridge cases.

SUMMARY OF THE INVENTION

The present invention provides a process for manufacturing very high strength, formed, closed or open end cartridge cases which can withstand heat treating to produce the required transverse yield strength to meet necessary dimensional tolerance requirements. The present invention accomplishes this utilizing relatively low cost alloy steels and a relatively inexpensive process which increases the yield strength without excessive warpage and eliminates stringers in the finished metal which may cause problems during shell firing.

The process of the present invention can be utilized to manufacture cartridge cases from alloy steels or carbon steels of several types. These include:

1. SAE 4027 to 4042 and/or SAE 4427 alloy steel series or modifications thereof;
2. SAE 4125 to 4140 and/or SAE 4320 to 4340 alloy steel series or modifications thereof;
3. AISI 1029 to 1040 carbon steel or modifications thereof. The steel or steel alloy is required to have been subjected to a prior melting practice which includes the addition of calcium to the melt, vacuum de-gassing and argon shrouding to eliminate alumina stringer formation or reformation during melting and casting. In this treatment, an amount of calcium is added to the melt to cause coagulation or pooling of any residual alumina ($Al_2O_3$) which may be contained therein. Gases absorbed in the melt are removed by pouring in a vacuum and an argon atmosphere is utilized to prevent additional gases from dissolving into the material before it is properly solidified. Uncoagulated alumina tends to form defects called stringers in the processed metal which may result in case splits upon firing.

Warpage control and final diameter tolerance control is achieved by processing the as-received metal alloy using several additional steps. The steps in the preferred treatment process in accordance with the present invention include an extrusion step in which the basic size and base configuration of the cartridge are formed by extrusion of a blank which is somewhat longer than the desired final cartridge case length. The extruded cartridge blank is then subjected to a stress relieving step in which the material is annealed at a temperature of about 1200° F. in air for about one hour. The steel alloy blank is thereafter subjected to air cooling. The material is then precisely resized as by a final sink draw step, using a sizing die to resize and re-round the shape.

The resized case is then subjected to a heat treatment hardening step in which it is austenitized at a temperature in the range from about 1525° F. to 1575° F. for about one hour. The material is thereafter subjected to interrupted quench (high temperature quench) from the austenitizing temperature. The temperature of the interrupted quench is preferably between 600° F. and 750° F. The quench is usually molten salt. The quenched case is next subjected to a cryogenic or freeze step at about −100° F. for approximately one hour. The material is then tempered at a temperature at or above 700° F. but below the recrystallization temperature of the material for approximately one hour.

As indicated above, the cartridge case is preferably extruded to a length greater than that necessary for the finished cartridge length. Toward the open end of the extruded cartridge case and beyond the end of the desired final length of the case, the extrusion is provided with one or more peripheral grooves formed in the material. These are formed by using a grooved mandrel in conjunction with a roller. The purpose of these grooves is to add sufficient additional strength to the thin wall of the material so that it can withstand normal subsequent heat treatment without suffering the distortion normally associated with heat treating tubes of the class having one closed end. While sufficient for closed-end tubes, the process certainly can also be used to process extruded cases which are relatively open-ended casings as well.

The process of the present invention enables the production of cartridge cases which are endowed with a transverse yield strength greatly in excess of 145,000 PSI, which is a minimum standard for some applications, in a manner which utilizes relatively low cost techniques. This enables the use of less expensive materials from which to construct the case in addition to the ability to use less expensive processes.

DESCRIPTION OF THE PREFERRED EMBODIMENT

The following description illustrates the principles of the process of the present invention with respect to certain specific carbon or alloy steels. While these materials may be preferred for certain specific applications of the invention, they are by no means intended to be exhaustive or limiting as to the materials which might be used. Thus, it is contemplated that other steels might be substituted for those described.

In accordance with the invention, the steel alloy billets utilized to for the cartridge blanks must be free of titanium nitride or silicon dioxide ($SiO_2$) inclusions or alumina in a form which may create stringers in the extruded stock. Thus, such steels as boron grade steel or silicon killed steel are not recommended because of the existence of stringer inclusions which have a potential for creating case splits in the long, thin-walled extruded cases. The stringer formation potential for alumina is eliminated by a special melting practice. The previous melt or original melt must employ a calcium treatment in which calcium is added to control the residual alumina ($Al_2O_3$) remaining from the addition of aluminum to aid in the removal of oxygen from the original steel melt. In addition, the melt, when poured, should be poured using a vacuum de-gassing process in which the pouring operation takes place in the evacuated chamber to remove gases dissolved in the melt and prevent additional dissolving of gases in the poured metal. Argon shrouding may also be used to prevent additional reactive gases from being absorbed in the steel. If these operations are performed prior to billet formation, the calcium will cause the coagulation or pooling of any residual alumina, thereby preventing the formation of stringers during piece part forming.

Figure 1:
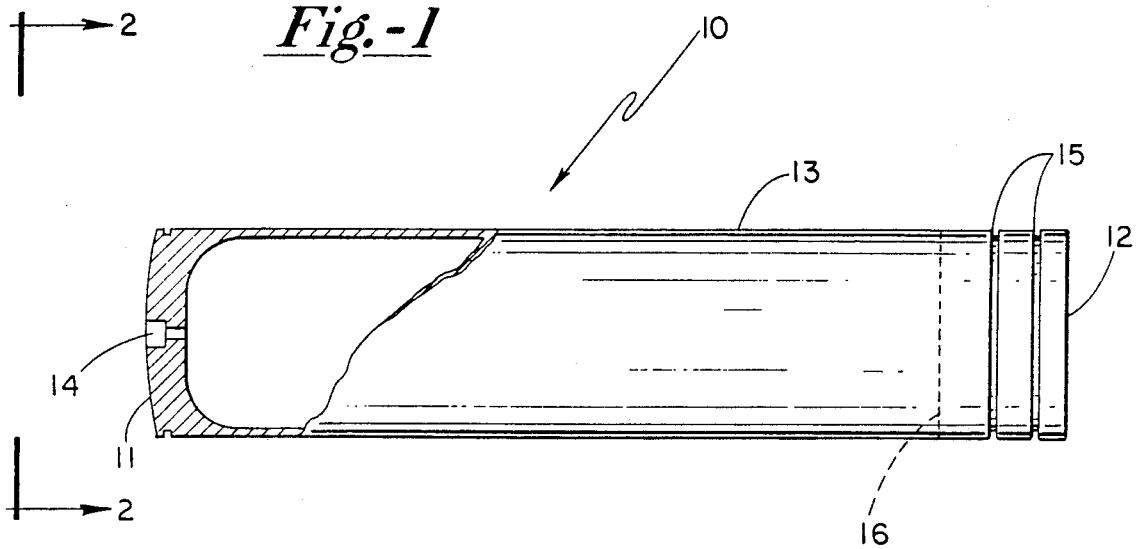
FIG. 1 is a view, partially in section, of a closed-end cartridge case which may be processed in accordance with the present invention.
Figure 2:
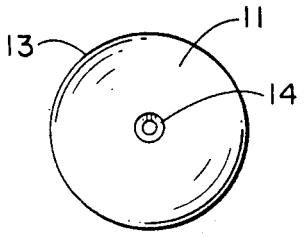
FIG. 2 is an end view of the cartridge case of FIG. 1.

FIG. 1 depicts a cartridge case typical of those of a closed-end class which may be advantageously manufactured by the process of the invention. The case shown generally at 10 is a single piece extruded from a small billet of metal to form a rather elongated, cylindrical shell having one closed end. It has a relatively thicker solid lower end 11 and an open end 12. The shell 10 is extruded as a straight sided cylinder as evidenced by side wall 13 which is untapered and of constant thickness. The closed end of the cartridge is supplied with a drilled or die punched opening as at 14 which is adapted to receive the firing mechanism for the shell. The extruded cartridge blank 10 is further provided with one or more peripheral grooves 15 close to the open end and beyond the end of the finished cartridge designated by the dotted line 16. The grooves add a decided amount of strength to the unsupported open end of the cartridge to greatly reduce or prevent warpage during subsequent heat treatment steps. In addition, the opening 14 is provided in the closed end of the cartridge prior to heat treatments to facilitate the evacuation of air and flow of quenching medium through the formed piece during marquenching.

Figure 3:
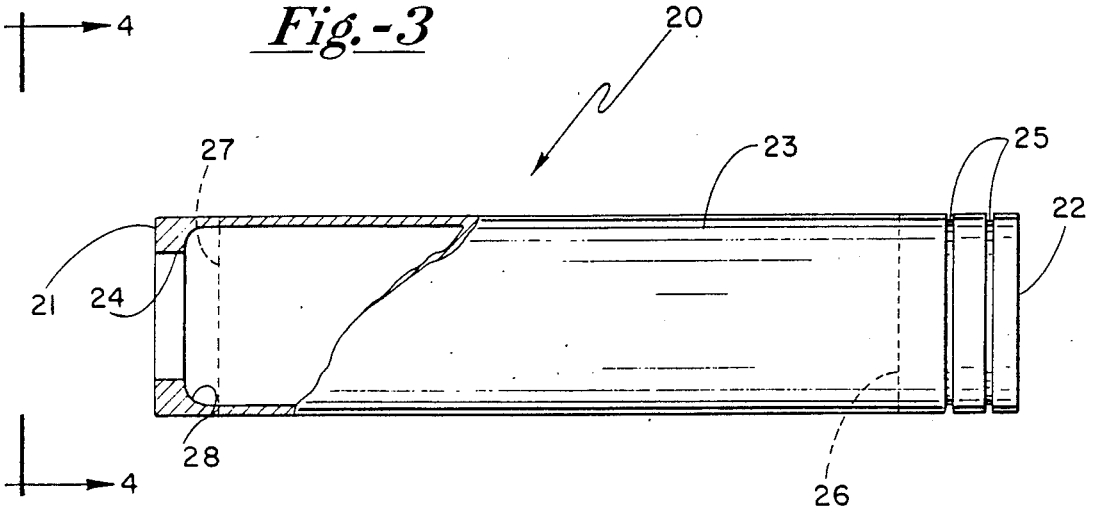
FIG. 3 is a view, partially in section, of an open-ended cartridge case tube which may be processed in accordance with the present invention.
Figure 4:
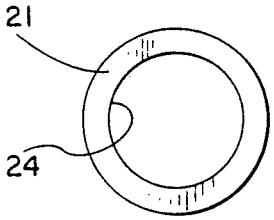
FIG. 4 is an end view of the cartridge case of FIG. 3.

FIG. 3 illustrates an open-ended cartridge case of a type which may advantageously be manufactured by the process of the invention. The case shown generally at 20 is a single piece extruded from a small billet of metal to form a rather elongated, cylindrical shell having one open end 22 and a relatively thicker solid lower end 21 which contains a rather large opening 24 formed therein. The shell 20 is extruded as a straight sided cylinder as evidenced by side wall 23 which is untapered and of constant thickness. The relatively large opening 14 is designed to aid in passing quenching media or the like during heat treatment but retains enough thickness to prevent lower end warpage. The extruded cartridge blank 20 is further provided with one or more peripheral grooves 25 close to the open end and beyond the end of the finished cartridge designated by the dotted line 26. As in the case of the closed end design, the grooves add a decided amount of strength to the unsupported open end of the cartridge to greatly reduce or prevent warpage of the open end during subsequent heat treatment steps. The dotted line 27 toward the lower end of the case represents the end of the side wall for the open-ended cartridge. As extruded, the open-ended cartridge blank is relatively squared off at the lower end and the area where the base meets the side wall at 28 has a relatively abrupt taper compared with the closed-ended version.

The process of manufacture of the high strength cases in accordance with the present invention (whether open or closed ended) begins with the extrusion forming of the elongated, thin-walled case from a billet subjected to the above-described melting practice. Prior to the extrusion step, the billets are annealed at an austenite conditioning temperature above 1200° F. for approximately one hour and allowed to cool at room temperature. This imparts a uniform softness to the material sufficient to enable uniform extrusion. After the cartridge case (open or closed ended) has been extruded, it is subjected to a stress relieving step in which the material is annealed at a temperature of about 1200° F. in air for about one hour. The steel alloy blank is thereafter subjected to air cooling. The material is then precisely resized as by a final sink draw step, using a sizing die to resize and re-round the shape. This procedure creates a stress relieved part that will not distort during the heating up part of the heat treat hardening procedure.

The resized case is then mounted on a mandrel having one or more recesses and subjected to a rolling step to impart the one or more grooves 15 or 25 to the structure, if desired. The concentric hole 14 in the closed case bottom is also provided by drilling or die punching. The case product is then subjected to a further heat treatment hardening step in which it is austenitized at a temperature in the range from about 1525° F. to 1575° F. for about one hour. The material is thereafter subjected to interrupted quench (high temperature quench) from the austenitizing temperature. The temperature of the interrupted quench is preferably between 600° F. and 750° F. The quench accomplishes a rapid conversion of the austenite to the stronger martensite. The quench medium is usually molten salt.

The quenched case is next subjected to a freeze step at about −100° F. for approximately one hour. The freeze step will remove any retained austenite that did not convert to martensite during the quench step. A temperature of −100° F. is well below the $M_s$ point for the alloy steels of interest. The quench and freeze steps are further designed to assure that the austenite is transformed into martensite prior to further hardening rather than into ferrite or pearlite. These two latter phases should be avoided because the associated volume expansion differences will cause unwanted distortion in the shaped case. The material is then subjected to tempering at a temperature at or above 700° F. but below the recrystallization temperature of the material for approximately one hour.

It is believed that cartridge cases fabricated in accordance with the process of the present invention will possess a circumferential yield strength in excess of 145,000 PSI. The process is designed to eliminate extrusion and heat treating distortion and provide a finished diameter control which allows the shells to subsequently fire and pass through a straight walled chamber quite reliably.

The concept of the present invention creates a lower cost product through the integration of one end seal into the cartridge case by extrusion. This is coupled with the use of a less expensive material, i.e., carbon or low alloy steel, which is much cheaper than high nickel/chromium stainless steels and a rather inexpensive heat treating practice.

This invention has been described in this application in considerable detail in order to comply with the Patent Statutes and to provide those skilled in the art with the information needed to apply the novel principles and to construct and use such specialized components as are required. However, it is to be further understood that the invention can be carried out by specifically different equipment and devices and that various modifications both as to equipment and procedure details can be accomplished without departing from the scope of the invention itself.

What is claimed is:

1. A method of manufacturing high strength, high precision thin-walled cartridge cases from a metal of interest selected from low alloy steels comprising the steps of:

extruding a closed-end cartridge case blank from a billet of the metal of interest;

austenitizing the formed cartridge case blank at a temperature in an approximate range of 1525° F. to 1575° F.;

subjecting the austenitized cartridge blank to an interrupted quench at a temperature in an approximate range of 600° F. to 750° F.;

freezing the quenched case at a temperature of about −100° F.;

tempering the case blank at a temperature at or above 700° F.

2. The method of claim 1 wherein the metal of interest has been previously subjected to a melting step which employs calcium treatment, vacuum de-gassing and argon shrouding to eliminate stringer formation.

3. The method of claim 2 wherein the cartridge blank is extruded to a length greater than that necessary for the finished cartridge and wherein the method further comprises the step of providing one or more peripheral grooves close to the open end of the extruded cartridge blank beyond the final designated length.

4. The method of claim 2 further comprising the steps of:

stress relieving the blank after extrusion at a temperature of approximately 1200° F. in air for approximately one hour; and subjecting the stress relieved blank to air cooling prior to austenitizing.

5. The method of claim 4 wherein the cartridge blank is extruded to a length greater than that necessary for the finished cartridge and wherein the method further comprises the sep of providing one or more peripheral grooves close to the open end of the extruded cartridge blank beyond the final designated length.

6. The method of claim 4 further comprising the step of subjecting the extruded blank to a sizing draw after stress relieving and prior to austenitizing.

7. The method of claim 6 wherein the cartridge blank is extruded to a length greater than that necessary for the finished cartridge and wherein the method further comprises the step of providing one or more peripheral grooves close to the open end of the extruded cartridge blank beyond the final designated length.

8. The method of claim 7 wherein the metal of interest is selected from the groups consisting of 4027 to 4042, and 4427 steels or alloys thereof.

9. The method of claim 7 wherein the metal of interest is selected from the group consisting of SAE 4125 to 4140 and SAE 4320 to 4340 series alloy steel or alloys thereof.

10. The method of claim 7 wherein the metal of interest is selected from the group consisting of AISI 1029 to 1040 series steels or alloys thereof.

11. The method of claim 1 further comprising the steps of:

stress relieving the blank after extrusion at a temperature of approximately 1200° in air for approximately one hour; and subjecting the stress relieved blank to air cooling prior to austenitizing.

12. The method of claim 11 further comprising the step of subjecting the extruded blank to a sizing draw after stress relieving and prior to austenitizing.

13. The method of claim 1 wherein the cartridge blank is extruded to a length greater than that necessary for the finished cartridge and wherein the method further comprises the step of providing one or more peripheral grooves close to the open end of the extruded cartridge blank beyond the final designated length.

14. The method of claim 1 wherein the metal of interest is selected from the groups consisting of 4027 to 4042, and 4427 steels or alloys thereof.

15. The method of claim 1 wherein the metal of interest is selected from the group consisting of SAE 4125 to 4140 and SAE 4320 to 4340 series alloy steel or alloys thereof.

16. The method of claim 1 wherein the metal of interest is selected from the group consisting of AISI 1029 to 1040 series steels or alloys thereof.

17. A method of manufacturing high strength, high precision thin-walled cartridge cases metal of interest selected from low alloy, molybdenum chromium alloy steels, wherein the metal of interest has bene previously subjected to a melting step which employs calcium treatment, vacuum de-gassing and argon shrouding to eliminate stringer formation during forming, comprising the steps of:

extruding a closed-end cartridge case blank from a billet of the metal of interest in a manner such that the cartridge blank is extruded to a length greater than that necessary for the finished cartridge;

providing one or more peripheral grooves close to the open end of said extruded cartridge blank beyond the final designated length;

austenitizing the formed cartridge case blank at a temperature in an approximate 1525° F. to 1575° F.;

subjecting the austenitized blank to an interrupted quench at a temperature in an approximate range to 600° F. to 750° F.;

freezing the quenched case at a temperature of about −100° F.;

18. The method of claim 17 wherein the metal of interest is selected from the groups consisting of 4027 to 4042, and 4427 steels or alloys thereof.

19. The method of claim 17 wherein the metal of interest is selected from the group consisting of SAE 4125 to 4140 and SAE 4320 to 4340 series alloy steel or alloys thereof.

20. The method of claim 17 wherein the metal of interest is selected from the group consisting of AISI 1029 to 1040 series steels or modifications thereof.

21. The method of claim 17 further comprising the steps of:

stress relieving the blank after extrusion at a temperature of approximately 1200° F. in air for approximately one hour;

subjecting the stress relieved blank to air cooling prior to austenitizing; and subjecting the extruded blank to a sizing draw after stress relieving and prior to austenitizing.

22. The method of claim 21 wherein the metal of interest is selected from the groups consisting of 4027 to 4042, and 4427 steels or alloys thereof.

23. The method of claim 21 wherein the metal of interest is selected from the group consisting of SAE 4125 to 4140 and SAE 4320 to 4340 series alloy steel or alloys thereof.

24. The method of claim 21 wherein the metal of interest is selected from the group consisting of AISI 1029 to 1040 series steels or alloys thereof.

* * * * *

UNITED STATES PATENT AND TRADEMARK OFFICE

CERTIFICATE OF CORRECTION

PATENT NO. : 5 048 162

DATED : September 17, 1991

INVENTOR(S) : Stanley R. Nelson

It is certified that error appears in the above-identified patent and that said Letters Patent is hereby corrected as shown below:

In column 6, line 57, delete "about" and insert -- approximately -- .

In column 7, line 13, delete "sep" and insert -- step -- .

In column 8, line 9, delete "bene" and insert -- been -- .

In column 8, line 22, after "approximate" insert -- range of -- .

In column 8, line 24, delete "to" and insert -- of -- .

Signed and Sealed this

Eleventh Day of May, 1993

*Attest:*

Michael K. Kirk

MICHAEL K. KIRK

*Attesting Officer*

*Acting Commissioner of Patents and Trademarks*